US009593590B2

(12) United States Patent
Ebert et al.

(10) Patent No.: US 9,593,590 B2
(45) Date of Patent: Mar. 14, 2017

(54) ACTIVE BYPASS FLOW CONTROL FOR A SEAL IN A GAS TURBINE ENGINE

(71) Applicant: Siemens Energy, Inc., Orlando, FL (US)

(72) Inventors: Todd A. Ebert, West Palm Beach, FL (US); Keith D. Kimmel, North Palm Beach, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 463 days.

(21) Appl. No.: 14/193,000

(22) Filed: Feb. 28, 2014

(65) Prior Publication Data

US 2014/0248133 A1 Sep. 4, 2014

Related U.S. Application Data

(60) Provisional application No. 61/771,151, filed on Mar. 1, 2013.

(51) Int. Cl.
*F01D 17/10* (2006.01)
*F01D 5/08* (2006.01)
(Continued)

(52) U.S. Cl.
CPC ..... *F01D 17/105* (2013.01); *F01D 5/081* (2013.01); *F01D 11/001* (2013.01); *F01D 11/04* (2013.01);
(Continued)

(58) Field of Classification Search
CPC ..... F01D 11/02; F01D 11/04; F01D 11/06; F01D 5/082; F01D 5/081; F01D 11/025;
(Continued)

(56) References Cited

U.S. PATENT DOCUMENTS 3,334,521 A * 8/1967 Kast ..... F01D 17/162 74/107
4,708,588 A * 11/1987 Schwarz ..... F01D 5/081 415/115
(Continued)

FOREIGN PATENT DOCUMENTS

CN 86108718 A 6/1987
CN 1129278 A 3/1996
(Continued)

*Primary Examiner* — Igor Kershteyn
*Assistant Examiner* — Justin Seabe

(57) ABSTRACT

An active bypass flow control system for controlling bypass compressed air based upon leakage flow of compressed air flowing past an outer balance seal between a stator and rotor of a first stage of a gas turbine in a gas turbine engine is disclosed. The active bypass flow control system is an adjustable system in which one or more metering devices may be used to control the flow of bypass compressed air as the flow of compressed air past the outer balance seal changes over time as the outer balance seal between the rim cavity and the cooling cavity wears In at least one embodiment, the metering device may include an annular ring having at least one metering orifice extending therethrough, whereby alignment of the metering orifice with the outlet may be adjustable to change a cross-sectional area of an opening of aligned portions of the outlet and the metering orifice.

17 Claims, 12 Drawing Sheets

(51) Int. Cl.
*F01D 11/00* (2006.01)
*F01D 11/04* (2006.01)
*F01D 11/06* (2006.01)

(52) U.S. Cl.
CPC ..... *F01D 11/06* (2013.01); *F05D 2270/301* (2013.01); *F05D 2270/58* (2013.01)

(58) Field of Classification Search
CPC .... F02C 7/12; F02C 7/125; F02C 7/16; F02C 7/18
See application file for complete search history.

(56) References Cited

U.S. PATENT DOCUMENTS 4,785,624 A * 11/1988 Smith ..... F01D 17/105 137/625.31
4,805,398 A 2/1989 Jourdain et al.
6,226,977 B1 * 5/2001 Ichiryu ..... F23M 5/085 60/39.23
6,428,272 B1 8/2002 Pepi et al.
6,675,872 B2 1/2004 Lewis et al.
6,779,967 B2 * 8/2004 Friedl ..... F02C 7/12 415/116
7,445,424 B1 11/2008 Ebert et al.
7,540,709 B1 6/2009 Ebert
7,607,307 B2 * 10/2009 Bergholz ..... F01D 5/082 415/116
7,748,959 B1 7/2010 Pinera et al.
8,133,014 B1 3/2012 Ebert et al.
8,240,986 B1 8/2012 Ebert
8,376,697 B2 2/2013 Wiebe et al.
8,578,720 B2 11/2013 Ebert et al.
8,584,469 B2 11/2013 Laurello et al.
8,613,199 B2 12/2013 Kimmel et al.
2010/0074731 A1 3/2010 Wiebe et al.
2010/0288376 A1 11/2010 Haasz et al.
2011/0247346 A1 10/2011 Kimmel et al.
2011/0247347 A1 10/2011 Ebert et al.
2011/0250057 A1 10/2011 Laurello et al.
2012/0057967 A1 3/2012 Laurello et al.

FOREIGN PATENT DOCUMENTS

CN 102341568 A 9/2010
EP 1873357 A2 1/2008
GB 1047530 A 11/1966
GB 2470253 A 11/2010
JP 2005009383 A 1/2005

* cited by examiner

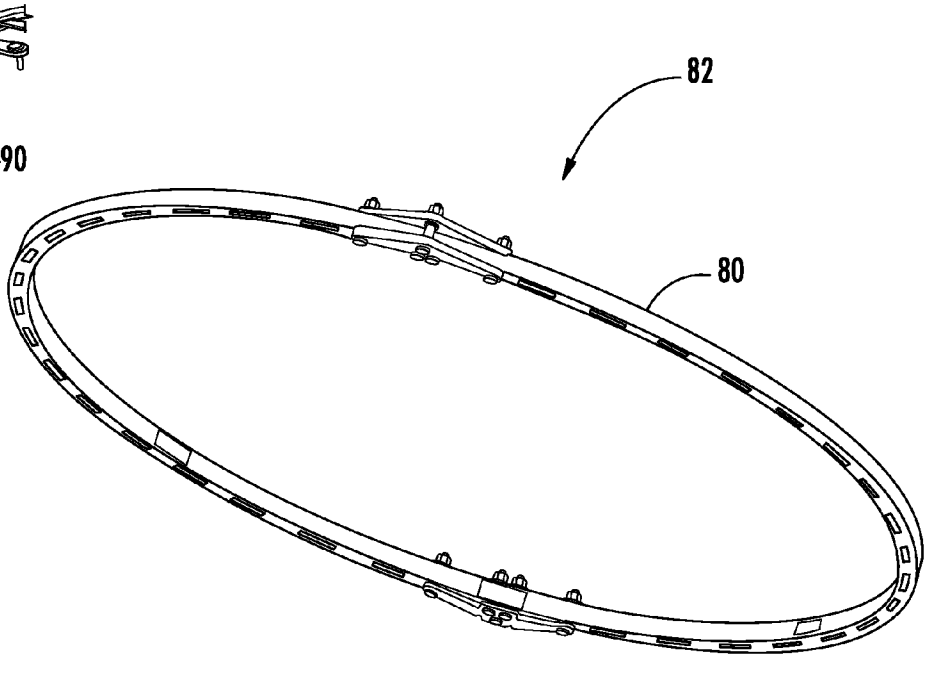
FIG. 23
FIG. 22
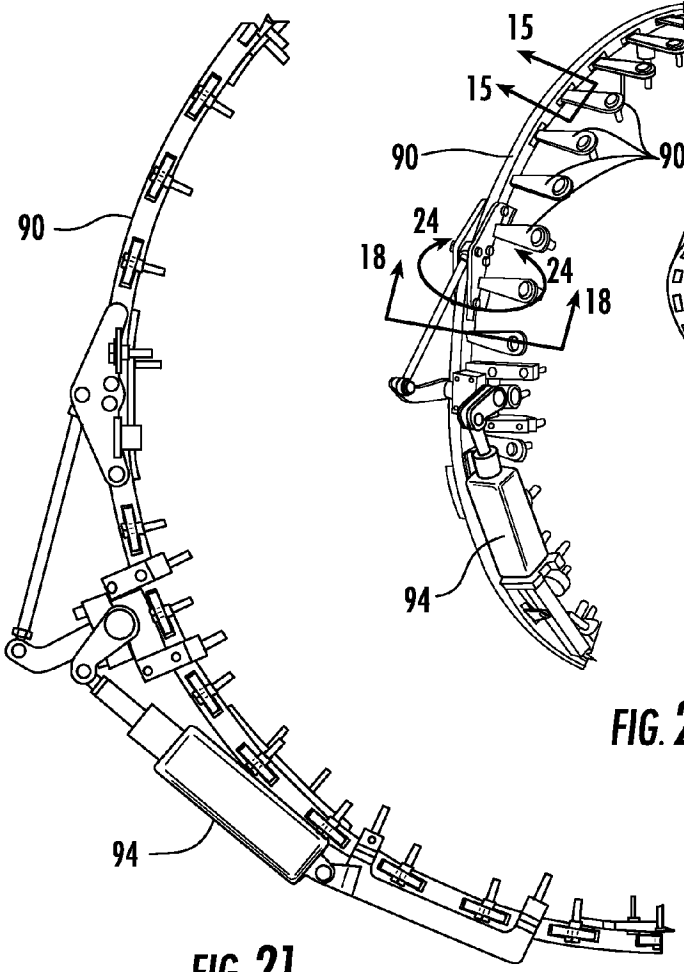
FIG. 21

ACTIVE BYPASS FLOW CONTROL FOR A SEAL IN A GAS TURBINE ENGINE

CROSS-REFERENCE TO RELATED APPLICATION

This application claims the benefit of U.S. Provisional Patent Application No. 61/771,151, filed Mar. 1, 2013, the entirety of which is incorporated herein.

STATEMENT REGARDING FEDERALLY SPONSORED RESEARCH OR DEVELOPMENT

Development of this invention was supported in part by the United States Department of Energy, Advanced Turbine Development Program, Contract No. DE-FC26-05NT42644 Accordingly, the United States Government may have certain rights in this invention.

FIELD OF THE INVENTION

This invention is directed generally to gas turbine engines, and more particularly, to an active bypass flow control system controlling the bypass of compressed air around one or more seals between a stator and a first stage rotor assembly to provide purge air to a rim cavity

BACKGROUND

Industrial gas turbine engines often have a rotor with a first stage turbine rotor blade and a stator with a first stage stator vane located downstream from a combustor A seal is typically positioned between the stator and the adjacent rotor to form a seal for a rim cavity that exists between the stator and rotor. Purge air is provided to the rim cavity via a bypass channel and via leakage past the seal A major problem with this structure is that the seal wears, and thus the leakage flow increases The discharge through the bypass channel is constant as long as the supply pressure remains the same. Thus, as the leakage flow across the seals increases, the cooling air from both pathways into the rim cavity, past the seal and from the bypass channel, increases A need thus exists to account for seal wear and extra leakage flow into the rim cavity so that the total cooling air flow to the rim cavity is not excessive

SUMMARY OF THE INVENTION

An active bypass flow control system for controlling bypass compressed air based upon leakage flow of compressed air flowing past an outer balance seal positioned between a stator and rotor of a first stage of a gas turbine in a gas turbine engine is disclosed The active bypass flow control system is an adjustable system in which one or more metering devices may be used to control the flow of bypass compressed air as the flow of compressed air past changes over time as the outer balance seals between the rim cavity and the cooling cavity wear In at least one embodiment, the metering device may include an annular ring having at least one metering orifice extending therethrough. The metering device may be positioned at the outlet of the bypass channel and may be adjustable such that alignment of the metering orifice with the outlet is adjustable to change a cross-sectional area of an opening of aligned portions of the outlet of the bypass channel and the metering orifice reducing or increasing the opening of aligned portions changing the flow of compressed air through the metering device.

In at least one embodiment, the active bypass flow control system may include a stator assembly positioned in proximity to a first stage rotor whereby a compressed air channel is positioned between a portion of the stator assembly and a rotor shaft. One or more outer balance seals may be configured to at least reduce a portion of hot gases from flowing into a cooling cavity In at least one embodiment, the outer balance seal may be a labyrinth seal formed from a plurality of teeth combined with a brush seal sealing a rim cavity from the cooling cavity. The outer balance seal may be positioned on a radially inward end of the rim cavity between the rim cavity and the cooling cavity One or more bypass channels may extend from an inlet in fluid communication with the compressed air channel upstream of the outer balance seal to an outlet in fluid communication with the compressed air channel downstream from the outer balance seal The active bypass flow control system may also include one or more metering devices that is adjustable to adjust the flow of cooling fluids through the bypass channel to accommodate a changing flow of compressed air past the outer balance seal as the outer balance seal wears during turbine engine operation.

The metering device may be formed from an annular ring having one or more metering orifices extending therethrough The metering device may be positioned at the outlet of the bypass channel and may be adjustable such that alignment of the metering orifice with the outlet is adjustable to change a cross-sectional area of opening of aligned portions of the outlet of the bypass channel and the metering orifice of the metering device In at least one embodiment, the metering device may include a plurality of metering orifices extending through the at least one metering device. In one embodiment, the plurality of metering orifices may be positioned equidistant from each other The plurality of metering orifices may be positioned in the metering device such that each of the metering orifices is aligned with a bypass channel in an open state The active bypass flow control system may also include a position control system for controlling position of the metering device relative to the outlet of the bypass channel. In at least one embodiment, the position control system may include a cam adjustor having an internal slot for receiving a post that retains the metering device relative to the outlet of the bypass channel The post may be capable of being moved within the slot to change the position of the metering device relative to the outlet of the bypass channel In at least one embodiment, the position control system may also include one or more control levers for changing alignment of the metering device relative to the outlet of the bypass channel The position control system may also include one or more motors usable to change alignment of the metering device relative to the outlet of the bypass channel The position control system may include one or more sensors configured to measure an amount of leakage flow occurring across the metering device In other embodiments, one or more sensors may be used to measure a pressure ratio across the metering device The position control system may include a controller in communication with the sensor and with the motor such that the controller controls operation of the motor to control alignment of the metering device relative to the outlet of the bypass channel based upon data derived from the sensor In yet another embodiment, the active bypass flow control system for an outer balance seal may include a stator assembly positioned in proximity to a first stage rotor whereby a compressed air channel is positioned between a portion of the stator assembly and a rotor shaft The active bypass flow control system may also include one or more outer balance seals configured to at least reduce a portion of hot gases from flowing into a cooling cavity One or more bypass channels may extend from an inlet in fluid communication with the compressed air channel upstream of the outer balance seal to an outlet in fluid communication with the compressed air channel downstream from the outer balance seal The active bypass flow control system may include one or more metering devices that is adjustable to adjust the flow of cooling fluids through the bypass channel to accommodate a changing flow of compressed air past the outer balance seal as the outer balance seal wears during turbine engine operation.

The metering device may include one or more valves formed from one or more pins movable between open and closed positions in which the pin at least partially bisects the bypass channel The metering device may also include one or more cams engaged to the pin to move the pin between open and closed positions In at least one embodiment, the cam may be formed from a collar positioned in contact with a head of the pin. The pin may also include one or more orifices located in the shaft of the pin and positioned such that the orifice is aligned with the bypass channel when the pin is in the open position The active bypass flow control system may also include a sync ring in communication with the pin via one or more valve arms extending from the pin to the sync ring The valve arm may be pivotably attached to the sync ring The sync ring may be attached to one or more cams engaged to the pin to move the pin between open and closed positions via at least one valve arm The sync ring may be cylindrical with a plurality of valve arms pivotably attached thereto. In another embodiment, the sync ring may also include a plurality of cams formed from slots contained within the sync ring The plurality of cams may be nonparallel and nonorthogonal to an axis tangential to curved midline of the sync ring These and other embodiments are described in more detail below

BRIEF DESCRIPTION OF THE DRAWINGS

The accompanying drawings, which are incorporated in and form a part of the specification, illustrate embodiments of the presently disclosed invention and, together with the description, disclose the principles of the invention

FIG. 21 is a partial side view of the sync ring of FIG. 23.

FIG. 22 is a partial perspective view of the sync ring of FIG. 23

FIG. 23 is a perspective view of an embodiment of a sync ring of the valve position control system

DETAILED DESCRIPTION OF THE INVENTION

Figure 7:
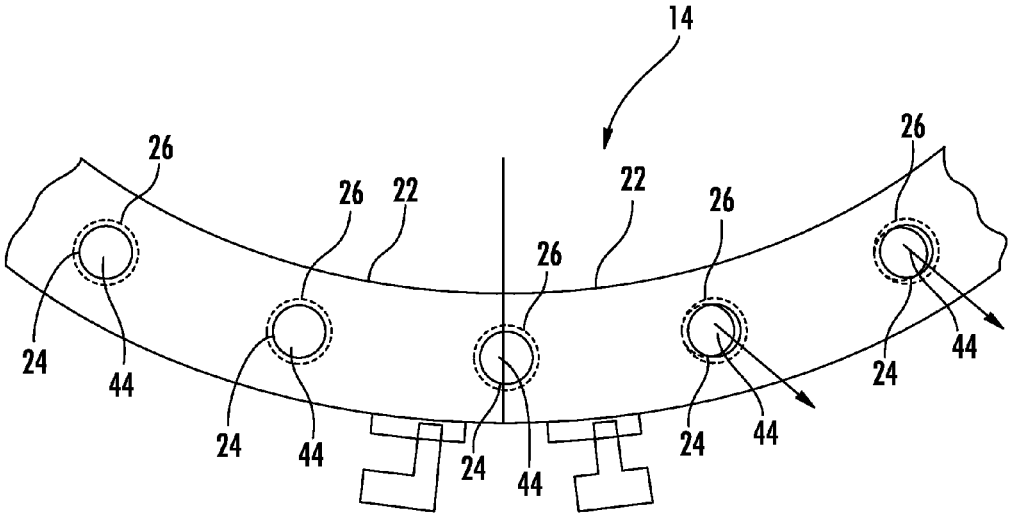
FIG. 7 is a cross-sectional view of a section of an alternative embodiment of the metering device with all metering orifices aligned at the zero setting whereby the opening is 100 percent open
Figure 8:
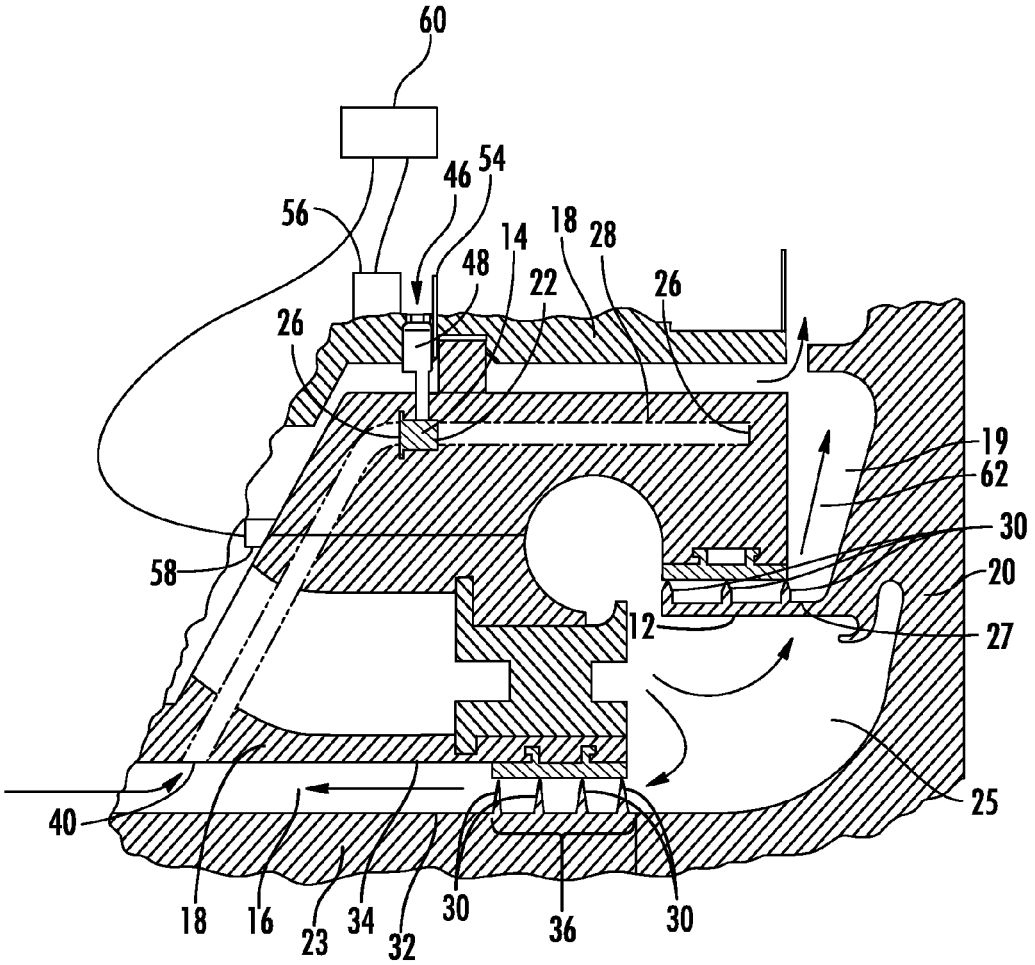
FIG. 8 is a cross-sectional, detailed view of another embodiment of the active bypass flow control system positioned with a first stage rotor and stator in an industrial gas turbine engine at detail line 2-2

As shown in FIGS. 1-25, an active bypass flow control system 10 for controlling bypass compressed air based upon leakage flow of compressed air flowing past an outer balance seal 12 between a stator 18 and rotor 20 of a first stage of a gas turbine 21 in a gas turbine engine is disclosed The active bypass flow control system 10 is an adjustable system in which one or more metering devices 14 may be used to control the flow of bypass compressed air as the flow of compressed air past changes over time as the outer balance seal 12 between the rim cavity 62 and the cooling cavity 25 wears In at least one embodiment, the metering device 14 may include an annular ring 22 having at least one metering orifice 24 extending therethrough. The metering device 14 may be positioned at the outlet 26 of the bypass channel 28 and may be adjustable such that alignment of the metering orifice 24 with the outlet 26 is adjustable to change a cross-sectional area of an opening 44 of aligned portions of the outlet 26 of the bypass channel 28 and the metering orifice 24 reducing or increasing the opening 44 of aligned portions changing the flow of compressed air through the metering device 14 In another embodiment, as shown in FIG. 8, the metering device 14 may be positioned between the outlet 26 of the bypass channel 28 and the inlet 40 or at the inlet 40

Figure 1:
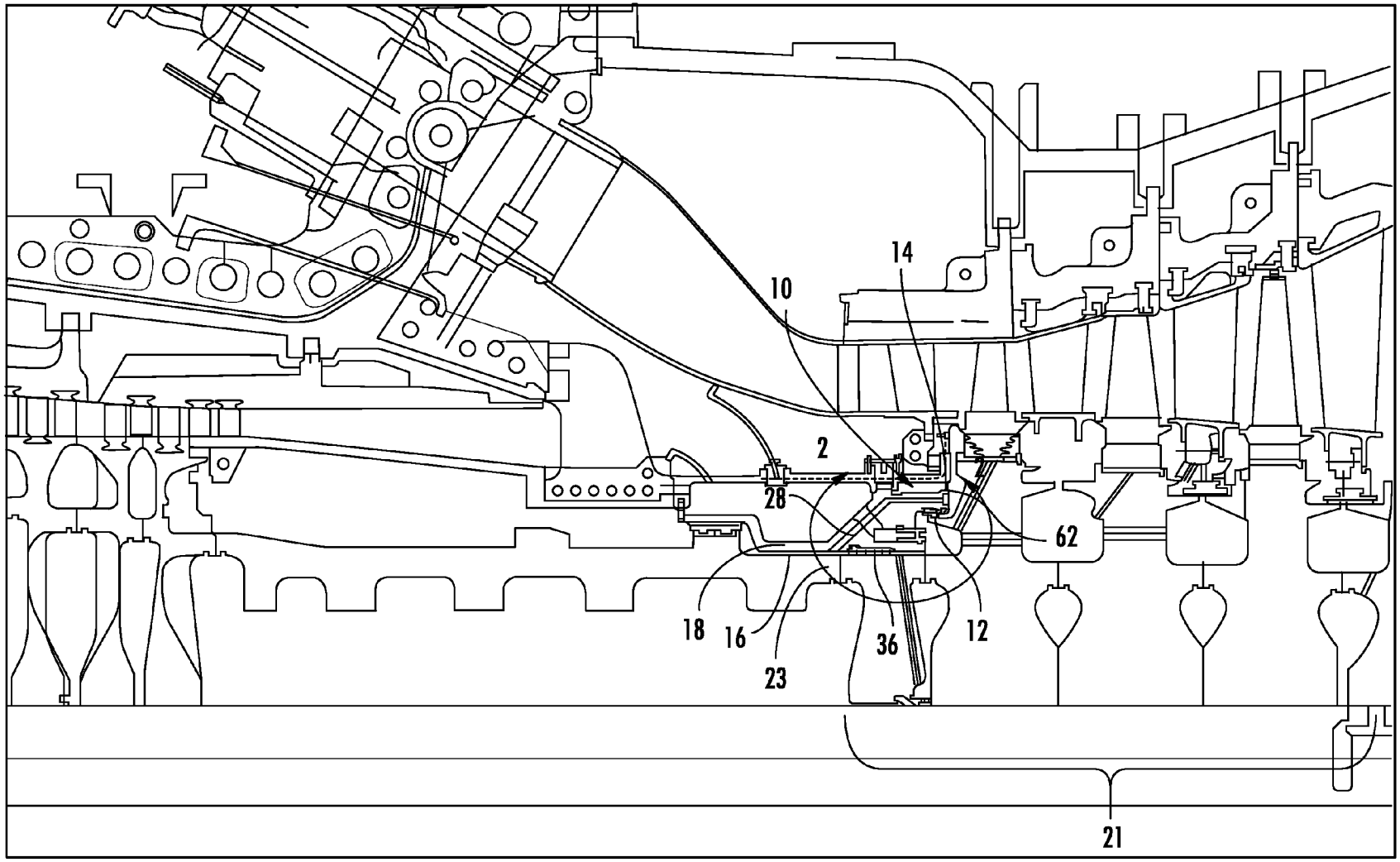
FIG. 1 is a cross-sectional view of a gas turbine engine with the active bypass flow control system controlling bypass compressed air around one or more seals between a rim cavity and a cooling cavity

As shown in FIG. 1, the active bypass flow control system 10 for an outer balance seal 12 may include a stator assembly 18 positioned in proximity to a rotor shaft 23 The stator assembly 18 may have any appropriate configuration. One or more compressed air channels 16 may be positioned between a portion of the stator assembly 18 and the rotor shaft 23 One or more outer balance seals 12 may be configured to at least reduce a portion of hot gases from flowing into a cooling cavity 25. In at least one embodiment, the outer balance seal 12 may eliminate all hot gas ingestion into the cooling cavity 25 The outer balance seal 12 may be, but is not limited to being, a labyrinth seal, brush seal, or leaf seal In at least one embodiment, the outer balance seal 12 may be a labyrinth seal formed from a plurality of teeth 30 combined with a brush seal sealing the rim cavity 62 from the cooling cavity 25. The outer balance seal 12 may be positioned on a radially inward end 27 of the rim cavity 62 between the rim cavity 62 and the cooling cavity 25 In at least some embodiments, the teeth 30 may substantially reduce, if not completely eliminate, the hot gas flow past the seal 12 into the cooling cavity 25 A inner balance seal 36 may be positioned radially inward of the outer balance seal 12 and may be, but is not limited to being, a labyrinth seal, brush seal, or leaf seal. In at least one embodiment, the inner balance seal 36 may include a plurality of teeth 30 extending from a first side 32 of the compressed air channel 16 to a second side 34 of the compressed air channel 16

Figure 2:
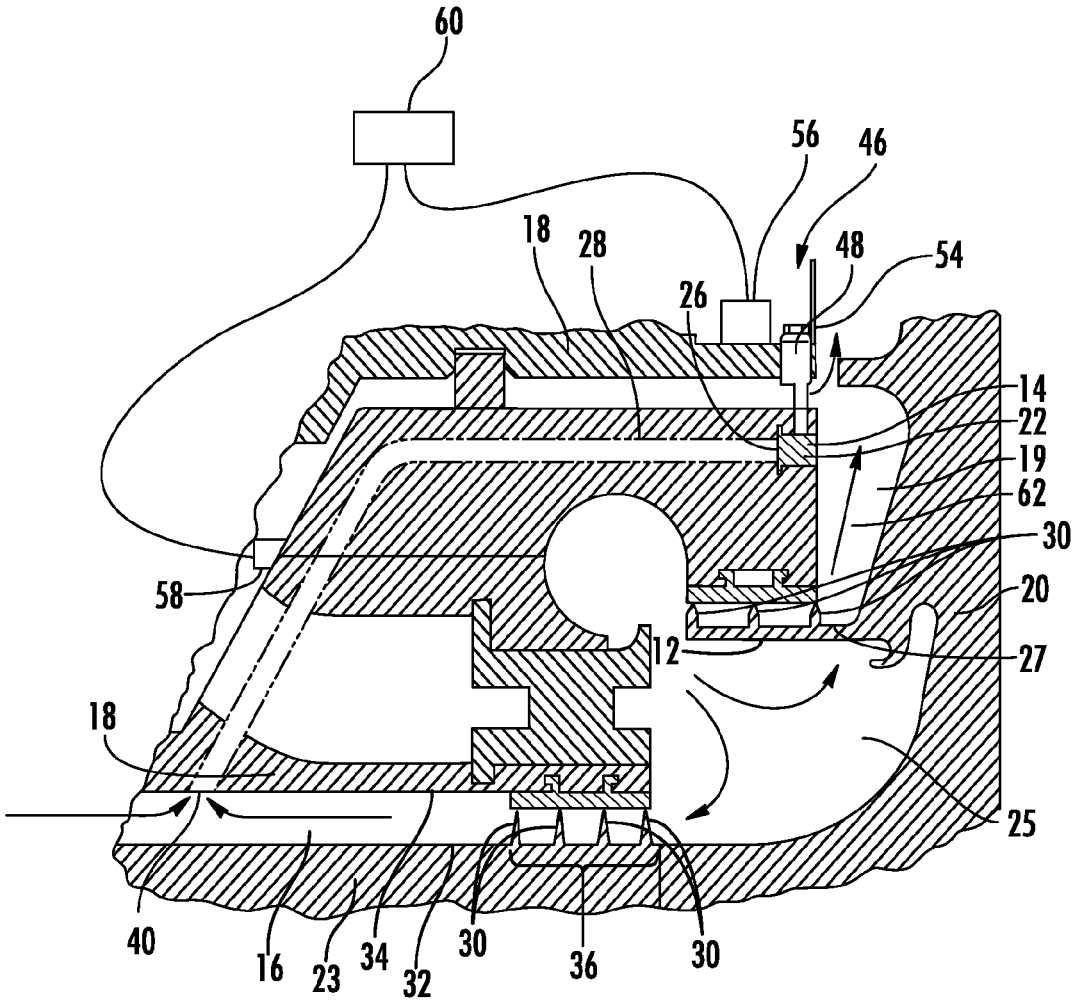
FIG. 2 is a cross-sectional, detailed view of the active bypass flow control system positioned with a first stage rotor and stator in an industrial gas turbine engine at detail line 2-2.

The active bypass flow control system 10 may also include one or more bypass channels 28 extending from an inlet 40 in fluid communication with the compressed air channel 16 upstream of the outer balance seal 12 to an outlet 26 in fluid communication with the compressed air channel 16 downstream from the outer balance seal 12 In at least one embodiment, the bypass channel 28 may be positioned within a portion of the stator assembly 18. As shown in FIG. 2, the bypass channel 28 may be positioned such that an inlet 40 of the bypass channel 28 is positioned in a laterally extending portion of the compressed air channel 16 upstream of the outer balance seal 12, and the outlet 26 is positioned in the rim cavity 62 downstream of the outer balance seal 12 The bypass channel 28 may be formed from any appropriate structure In at least one embodiment, the bypass channel 28 may be a cylindrical shaped channel In another embodiment, the bypass channel 28 may be a toroid shaped channel In yet another embodiment, the bypass channel 28 may be formed from a plurality of bypass channels positioned circumferentially about the circumferentially extending stator assembly 18

Figure 9:
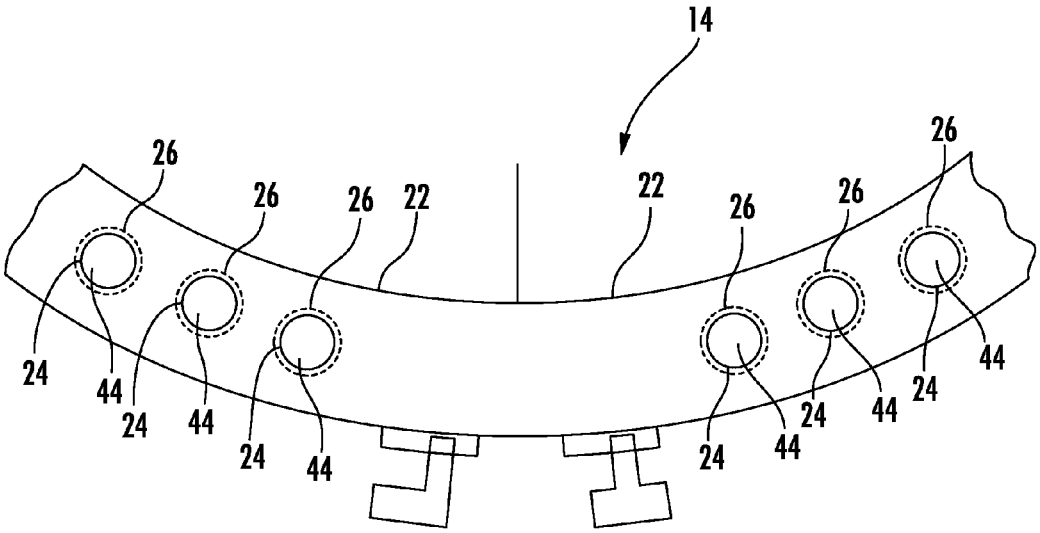
FIG. 9 is a cross-sectional view of a section of an another embodiment of the metering device with metering orifices ganged together to form collections of metering orifices on the metering device.

The active bypass flow control system 10 may also include one or more metering devices 14 that is adjustable to adjust the flow of cooling fluids through the bypass channel 28 to accommodate a changing flow of compressed air past the outer balance seal 12 as the outer balance seal 12 wears during turbine engine operation. In at least one embodiment, the metering device 14 may be an annular ring 22 having one or more metering orifices 24 extending therethrough. The metering device 14 may be positioned at the outlet 26 of the bypass channel 28 and may be adjustable such that alignment of the metering orifice 24 with the outlet 26 is adjustable to change a cross-sectional area of an opening 44 of aligned portions of the outlet 26 of the bypass channel 28 and the metering orifice 24 of the metering device 14. In at least one embodiment, the metering device 14 may include a plurality of metering orifices 24 extending through the metering device 14. In at least one embodiment, the plurality of metering orifices 24 may be positioned equidistant from each other, and, in other embodiments, the plurality of metering orifices 24 may be positioned in other configurations relative to each other. The plurality of metering orifices 24 may be positioned in the metering device 14 such that each of the metering orifices 24 is aligned with a bypass channel 28 in an open state, as shown in FIG. 7. In another embodiment, as shown in FIG. 9, the metering orifices 24 of the metering device 14 may be grouped into collections of metering orifices 24 such that a distance between each collection may be a distance without a metering orifices 24 that is greater than a distance between metering orifices 24 within each collection Each collection may have identical spacing between metering orifices 24 or may have different spacing Adjacent collections of metering orifices 24 may have identical spacing between metering orifices 24 or may have different spacing In at least one embodiment, the metering orifices 24 may be skewed or angled, as shown in FIG. 7, relative to the bypass channel 28 In particular, the metering orifices 24 may be skewed such that compressed gases flowing through the metering orifices 24 would impart at least a partial circumferential vector to the compressed gas flow. By skewing the metering orifices 24, performance applications would benefit from swirling the bypass flow exhausted form the bypass channel 28 into the rotor cavity 62

Figure 3:
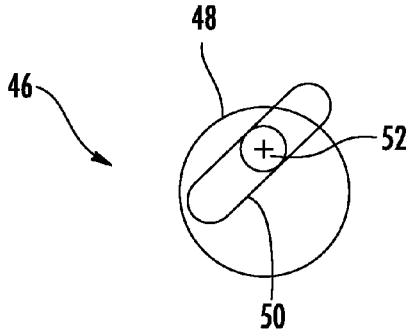
FIG. 3 is a top view of a cam adjustor at a zero degree setting whereby the opening is 100 percent open
Figure 4:
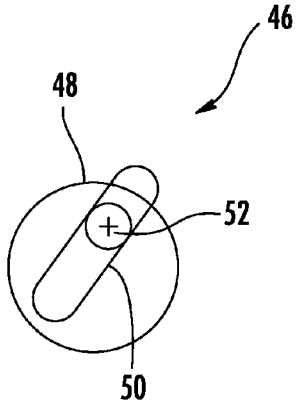
FIG. 4 is a top view of a cam adjustor at a twenty degree setting whereby the opening is less than 100 percent open
Figure 5:
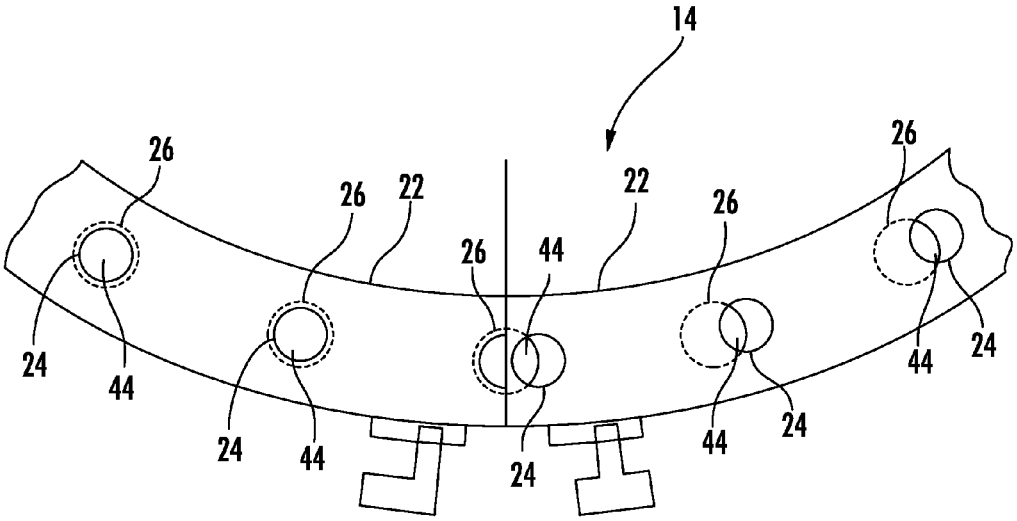
FIG. 5 is a cross-sectional view of a section of the metering device with metering orifices aligned at the zero setting on the left side and flow passageways offset at the twenty degree setting on the right side
Figure 6:
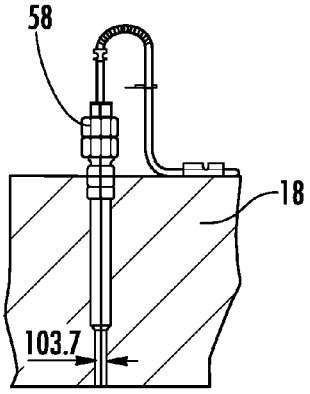
FIG. 6 is a detailed view of the sensor of the position control system of the active bypass flow control system.
Figure 10:
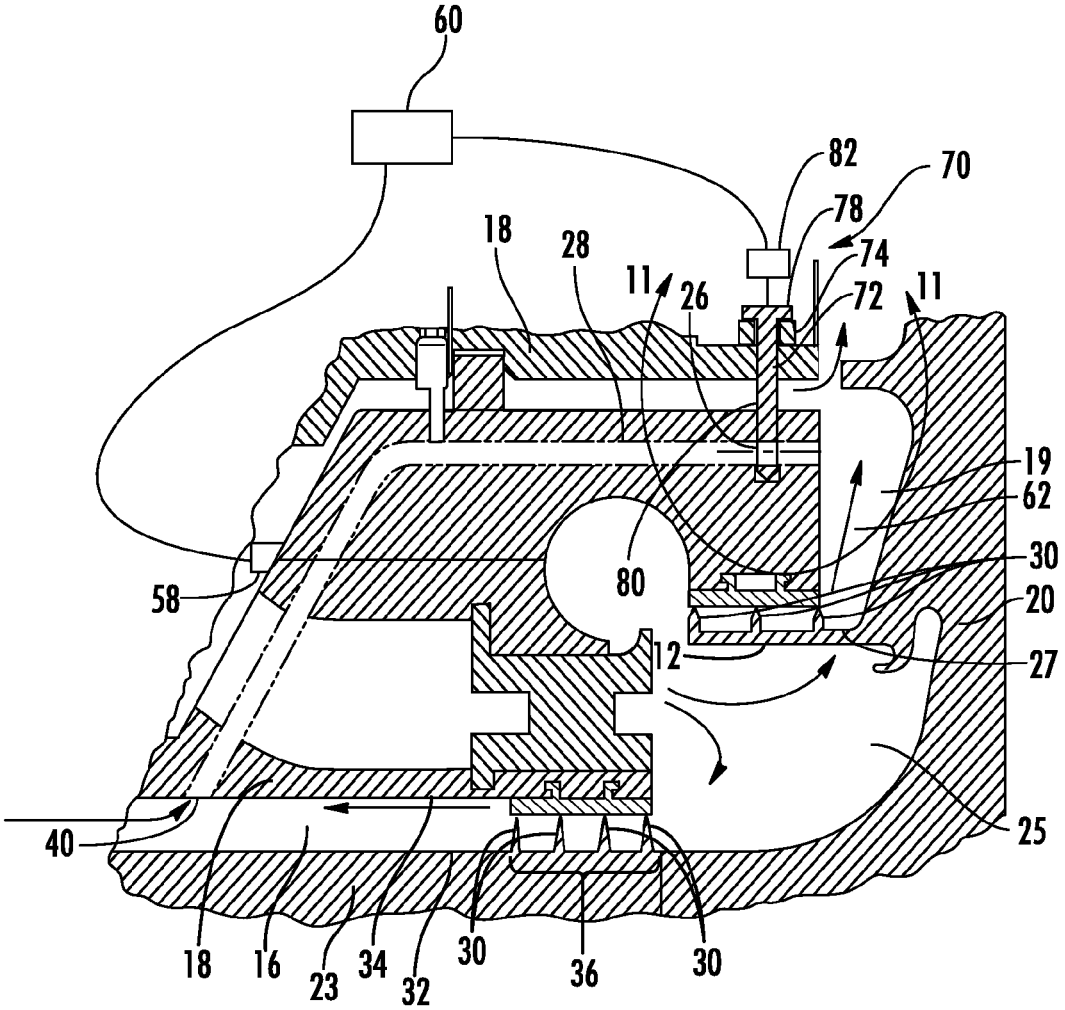
FIG. 10 is a cross-sectional, detailed view of yet another embodiment of the active bypass flow control system positioned with a first stage rotor and stator in an industrial gas turbine engine at detail line 2-2

The active bypass flow control system 10 may also include a position control system 46 for controlling position of the metering device 14 relative to the outlet 26 of the bypass channel 28. The position control system 46 may be, but is not limited to being, a manual system, a motor driven system, and an automatically adjustable system In at least one embodiment, as shown in FIGS. 3 and 4, the position control system 46 may be a cam adjustor 48 having an internal slot 50 for receiving a post 52 that retains the metering device 14 relative to the outlet 26 of the bypass channel 28, wherein the post 52 is capable of being moved within the slot 50 to change the position of the metering device 14 relative to the outlet 26 of the bypass channel 28 In at least one embodiment, the cam adjustor 48 may be positioned such that the metering orifice 24 is aligned with the outlet 26 of the bypass channel 28, which may be referred to as the cam adjustor being in a zero position, as shown in FIG. 3 In at least one embodiment, the cam adjustor 48 may be positioned such that the metering orifice 24 is offset with the outlet 26 of the bypass channel 28, which may be referred to as the cam adjustor being in a twenty degree position, as shown in FIG. 4 The position control system 46 may also include one or more control levers 54 for changing alignment of the metering device 14 relative to the outlet 26 of the bypass channel 28 The control lever 54 may have any appropriate configuration enabling adjustment of the metering device 14 relative to the outlet 26 during an outage when the engine is stopped or during operation, or both. In yet another embodiment, the position control system 10 may also include one or more motors 56 usable to change alignment of the metering device 14 relative to the outlet 26 of the bypass channel 28 The motor may be, but is not limited to, an electric motor, such as, but not limited to a stepper motor, a hydraulic motor, a pneumatic motor or a piezoelectric motor The position control system 46 may also include one or more sensors 58 configured to measure an amount of leakage flow occurring across the metering device 14 The sensor 58 may be any appropriate sensor 58 configured to detect pressure, such as, but not limited to, downstream preswirler pressure The sensor 58 may measure a pressure ratio across the metering device 14 or mass flow. In at least one embodiment of the active bypass flow control system 10, the position control system 46 may also include a controller 60 in communication with the sensor 58 and with the motor 56 such that the controller 60 controls operation of the motor 56 to control alignment of the metering device 14 relative to the outlet 26 of the bypass channel 28 based, at least in part, upon data derived from the sensor 58 The controller 60 may be, but is not limited to being, the turbine engine logic control system, a component within the turbine engine logic control system, any microcontroller, programmable controller, computer, personal computer (PC), server computer, a client user computer, a tablet computer, a laptop computer, a desktop computer, a control system, or any machine capable of executing a set of instructions (sequential or otherwise) that specify actions to be taken by the controller 60 Further, while a single controller 60 is illustrated, the term "controller" shall also be taken to include any collection of controllers that individually or jointly execute a set (or multiple sets) of instructions to perform any one or more of the methodologies discussed herein During use, compressed air is passed from a compressor into the compressed air channel 16 The compressed air is substantially prevented from entering the rim cavity 62 via the outer balance seal 12 and hot gas is substantially prevented from being ingested into the cooling cavity 25 from the rim cavity 62 The metering device 14 may be used to divert compressed air into the rim cavity 62 to purge hot gas from the rim cavity 62 when the outer balance seal 12 is preventing flow of the hot gas into the cooling cavity 25 and the compressed air channel 16 As the outer balance seal 12 wears and becomes less effective with greater compressed air leakage, the metering device 14 may be adjusted to exhaust less compressed air from the outlet 26 The flow of compressed air through the metering device 14 may be adjusted by adjusting the metering device 14 such that less of the metering orifices 24 is aligned with the outlet 26 of the bypass channel 28 The position of the metering device 14 may be adjusted when the turbine engine is operating or during an outage when the engine is shutdown The position of the metering device 14 may be adjusted manually, such as using the control lever 54 and cam adjustor 48, via one or more motors 56, via an automatic system as described above with the controller 60, motor 56 and sensor 58, or any combination of these systems In another embodiment, as shown in FIGS. 10-12, the active bypass flow control system 10 may include a metering device 14 formed from one or more valves 70 formed from one or more pins 72 that are each controlled by a cam 74 Each valve 70 may be configured to move axially along a longitudinal axis 76 of the pin 72 between an open position shown in FIG. 11 and a closed position shown in FIG. 12 The position of the valve 70 may be controlled via the cam 74 upon rotation of the cam 74 such that the position of a head 78 of the pin 72 varies relative to the bypass channel 28 In at least one embodiment, the cam 74 may be formed from a collar 86 with an orifice 88 that contains the pin 72 The collar 86 may be generally cylindrical and may be rotated to move the pin 72 between a closed and open position, or vice versa.

The pin 72 may include one or more orifices 80. The orifice 80 may be positioned and the pin 72 rotated such that in the open position, as shown in FIG. 11, the orifice 80 may be aligned with the bypass channel 28, thereby enabling the flow of gases through the pin 72 and through the bypass channel 28. The orifice 80 may have any appropriate size, such as larger, smaller or equal to a size of the bypass channel 28 The orifice 80 may be cylindrical or have another cross-sectional shape. The orifice 80 may be positioned and the pin 72 rotated such that in the closed position, as shown in FIG. 12, the orifice 80 may be at least partially misaligned with the bypass channel 28, thereby at least partially blocking the flow of gases through the pin 72 and through the bypass channel 28 In at least one embodiment, the orifice 80 may be positioned and the pin 72 rotated such that in the closed position, as shown in FIG. 12, the orifice 80 is misaligned with the bypass channel 28, thereby completely blocking the flow of gases through the pin 72 and through the bypass channel 28

Figure 11:
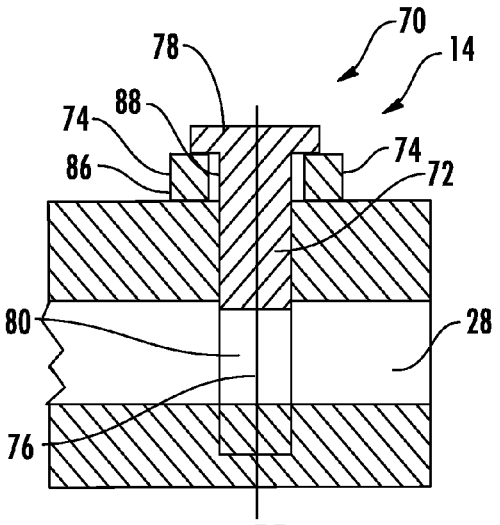
FIG. 11 is a detailed cross-sectional view of another embodiment of a metering device in an open position taken at detail line 11-11 in FIG. 10
Figure 13:
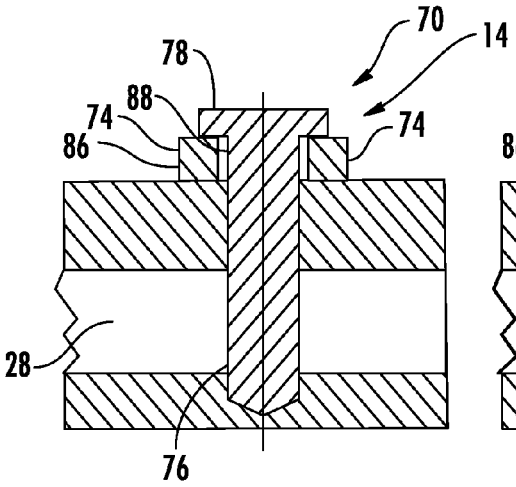
FIG. 13 is a detailed cross-sectional view of yet another embodiment of a metering device in a closed position taken at detail line 11-11 in FIG. 10
Figure 14:
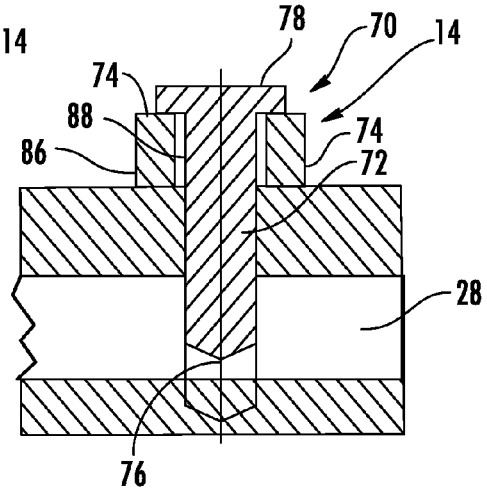
FIG. 14 is a detailed cross-sectional view of the embodiment of the metering device of FIG. 13 in an open position taken at detail line 11-11 in FIG. 10.

In another embodiment, the active bypass flow control system 10 may include a metering device 14 formed from one or more valves 70 formed from one or more pins 72 that are each controlled by a cam 74, as shown in FIGS. 13-14 Each valve 70 may be configured to move axially along a longitudinal axis 76 of the pin 72 between an open position shown in FIG. 14 and a closed position shown in FIG. 11. In the closed position shown in FIG. 13, the pin 72 may at least partially into the bypass channel 28, and, in at least one embodiment, may extend completely through the bypass channel 28 In the open position, as shown in FIG. 14, the pin 72 may be moved along the longitudinal axis 76 of the pin 72 such that the pin 72 no longer blocks the bypass channel 28. As shown in FIG. 14, the tip 84 of the pin 72 may be positioned within the bypass channel 28 or withdrawn completely from the bypass channel 28 The pin 72 may not have an orifice 80 but instead use a solid pin 72 to block the bypass channel 28. A solid pin 72, as shown in FIGS. 13 and 14 may also be used with in the embodiment shown in FIGS. 18-20

Figure 12:
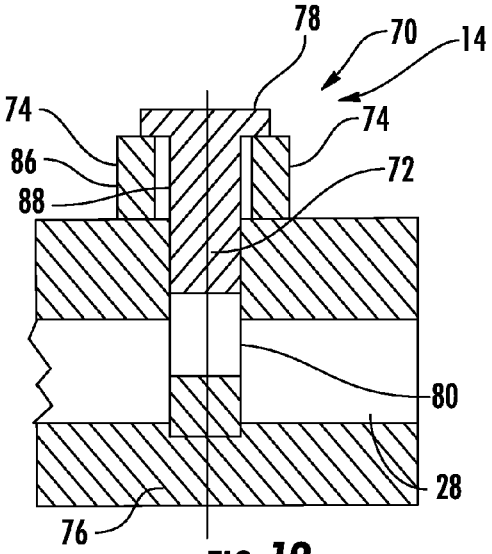
FIG. 12 is a detailed cross-sectional view of the embodiment of the metering device of FIG. 11 in a closed position taken at detail line 11-11 in FIG. 10
Figure 25:
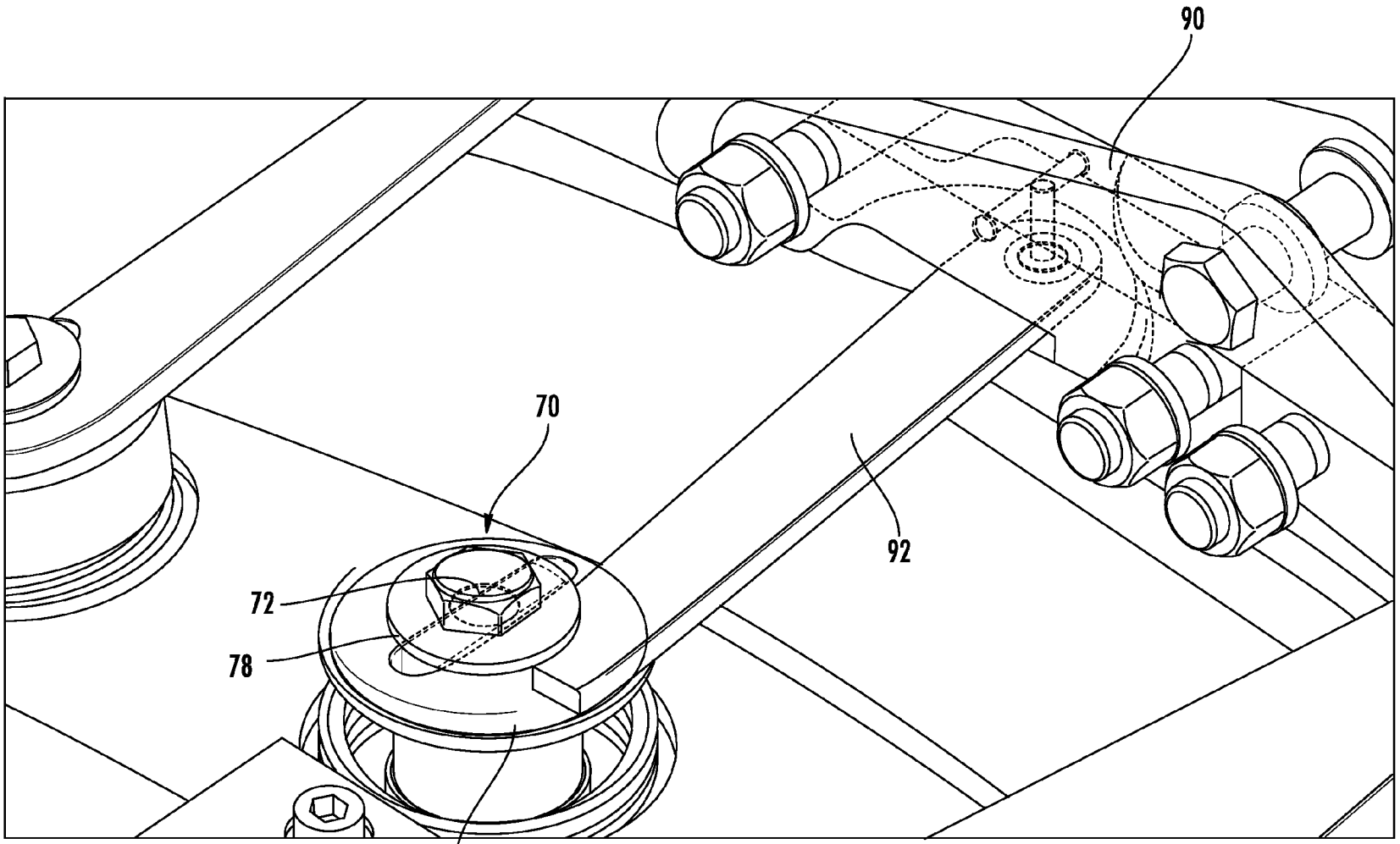
FIG. 25 is a detailed, perspective view of an another embodiment of the sync ring, valve arm, and valve of the valve position control system taken at section line 24-24 in FIG. 22

As shown in FIGS. 21-23 and 25, one or more valves 70 may be controlled via a valve position control system 82 In at least one embodiment, the valve position control system 82 may be configured to control a plurality of valves 70 at the same time As such, the valve position control system 82 may move a plurality of valves 70 between an opened position, as shown in FIG. 11, and a closed positioned as shown in FIG. 12, simultaneously, or vice versa As shown in FIG. 25, the valve position control system 82 may include a sync ring 90 coupled to each of the cams 74 supporting the valves 70 via valve arms 92 to control movement of the valves 70 simultaneously via movement of the sync ring 90 When the sync ring 90 is rotated circumferentially about a longitudinal axis of the gas turbine 21, the valve arm 92 rotates the cam 74 to which it is attached, thereby causing the pin 72 to either raise or lower. Raising or lowering the pin 72 causes the bypass channel 28 to be opened or closed The sync ring 90, as shown in FIGS. 21-23, may have any appropriate shape and size The sync ring 90 may form a continuous circle or may be formed from a partial circle The position of the sync ring 90 may be controlled by one or more actuators 94, as shown in FIGS. 21 and 22 The actuator 94 may be hydraulic, pneumatic or other appropriate device The actuator 94 may be coupled to a stationary aspect of the turbine engine and another portion of the actuator 94 may be coupled to the sync ring 90

Figure 15:
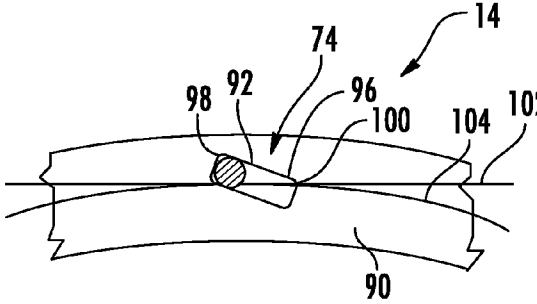
FIG. 15 is a front, axial view of a sync ring with a portion of a valve arm contained within a slot forming a cam when a valve is in an open position taken at section line 15-15 in FIG. 22
Figure 16:
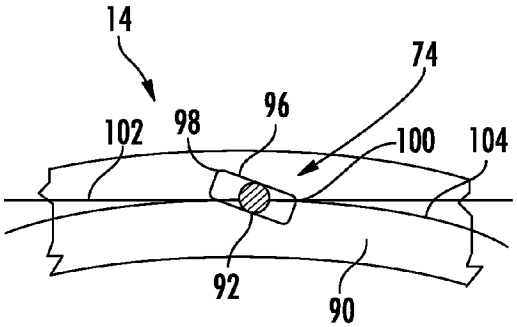
FIG. 16 is a front, axial view of a sync ring with a portion of a valve arm contained within a slot forming a cam when a valve is in a neutral position taken at section line 15-15 in FIG. 22
Figure 17:
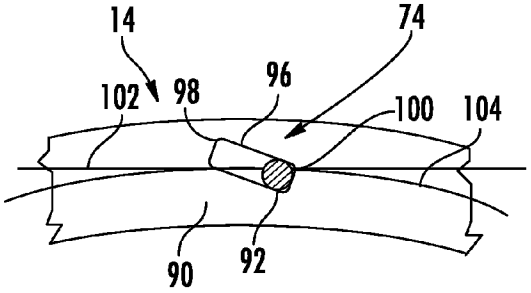
FIG. 17 is a front, axial view of a sync ring with a portion of a valve arm contained within a slot forming a cam when a valve is in a closed position taken at section line 15-15 in FIG. 22.
Figure 18:
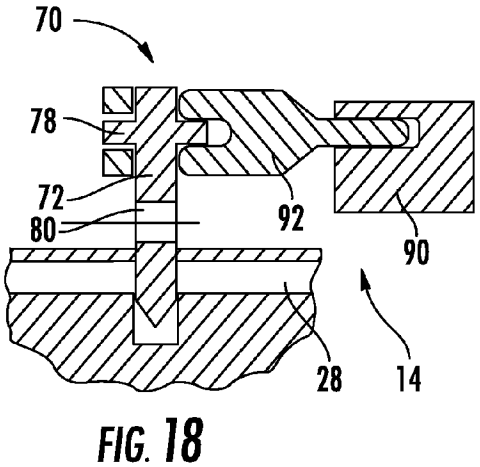
FIG. 18 is a side view of a sync ring with a portion of a valve arm contained within a slot forming a cam when a valve is in an open position taken at section line 18-18 in FIG. 22
Figure 19:
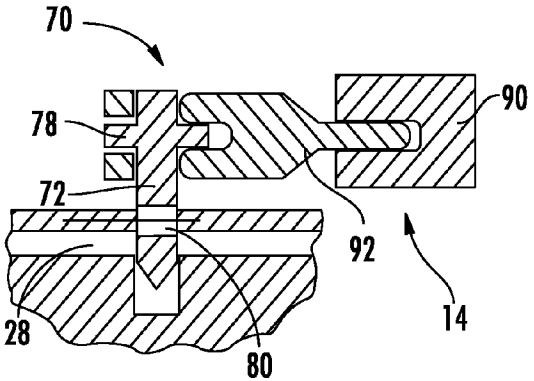
FIG. 19 is a front, axial view of a sync ring with a portion of a valve arm contained within a slot forming a cam when a valve is in a neutral position taken at section line 18-18 in FIG. 22
Figure 20:
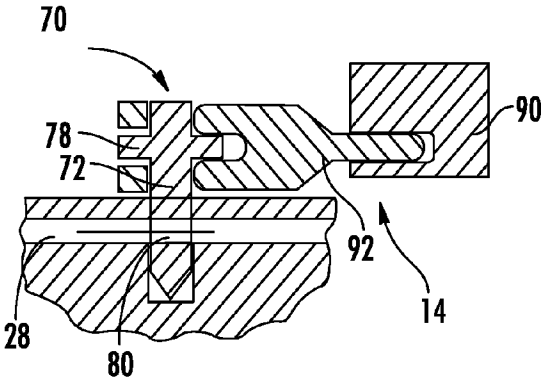
FIG. 20 is a front, axial view of a sync ring with a portion of a valve arm contained within a slot forming a cam when a valve is in a closed position taken at section line 18-18 in FIG. 22
Figure 24:
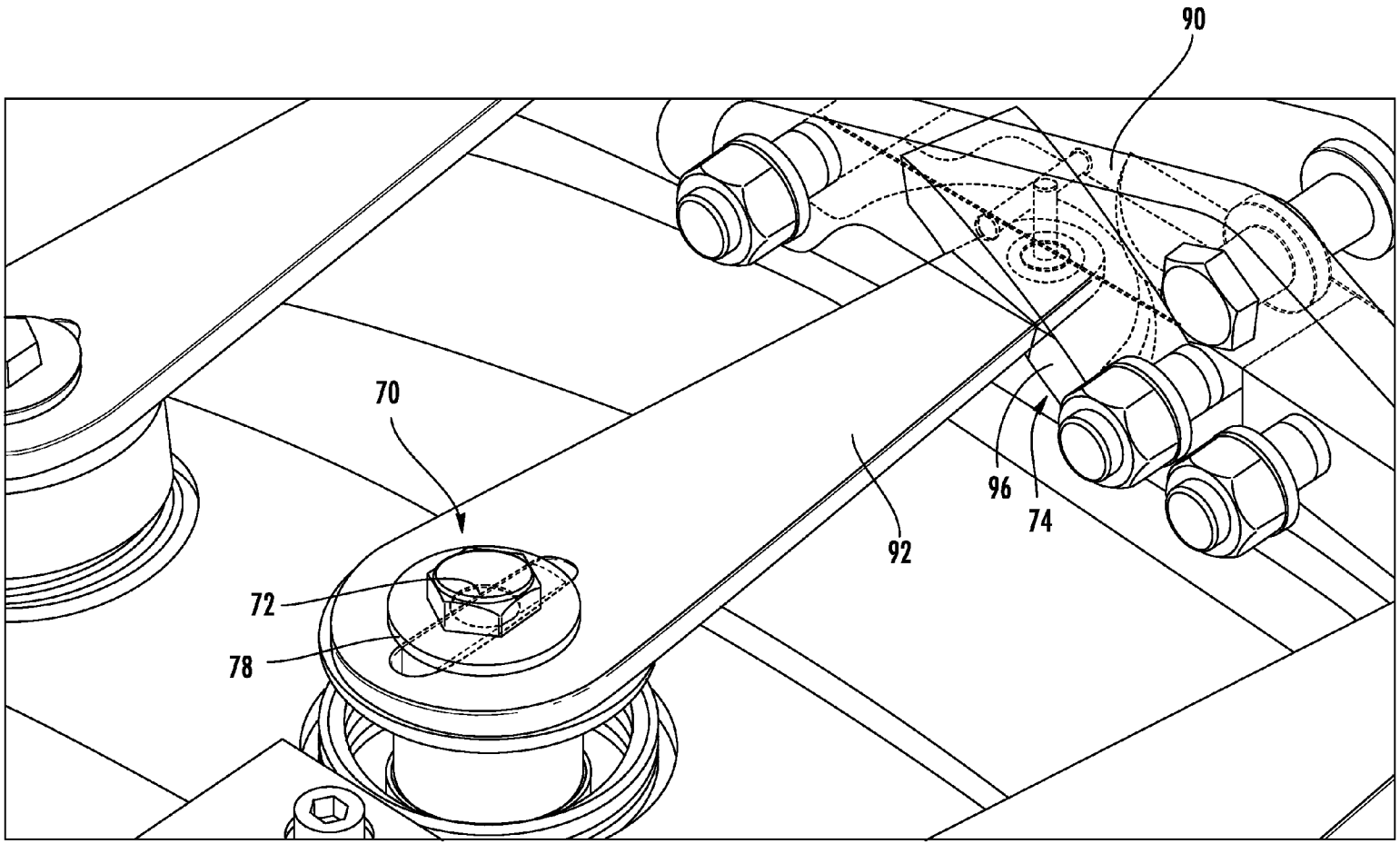
FIG. 24 is a detailed, perspective view of a sync ring, valve arm, and valve of the valve position control system taken at section line 24-24 in FIG. 22

In another embodiment, as shown in FIGS. 13-24, the active bypass flow control system 10 may include a metering device 14 formed from one or more valves 70 that are controlled via a sync ring 90 The sync ring 90 may include a cam 74 corresponding with each valve 70 In at least one embodiment, the cam 74 may be formed from a slot 96 corresponding with each valve 70 Each valve 70 may have a valve arm 92 extending from the valve 70 to the sync ring. The valve arm 92 may be attached to the head 78 of the pin 72 forming the valve 70 and may extend to the slot 96 The valve arm 92 may be slidably retained within the slot 96 such that the valve arm 92 may slide from a first end 98 to a second end 100 of the slot 96 The slot 96 is not tangential with the curved midline of the sync ring 90. Instead, the slot 96 is angled such that it is nonorthogonal and nonparallel to an axis 102 tangential with the curved midline 104 of the sync ring 90 With the slot 96 configured as such, the valve position control system 82 may move one or more valves 70 between an opened position, as shown in FIGS. 17 and 20, a nominal position, as shown in FIGS. 16 and 19, and a closed positioned, as shown in FIGS. 15 and 18, or vice versa. Thus, rotation of the sync ring 90 causes each pin 72 in communication with the sync ring 90 via a valve arm 92 to move radially inward or outward between open and closed positions shown in FIGS. 15-20. The valve arm 92 may have any appropriate shape and length Each slot 96 may be configured the same or, in a least one embodiment, the slots 96 may be positioned differently to create a desired effect upon the flow of gases through the bypass channel 28

In at least one embodiment, the active bypass flow control system 10 may be used to control a portion of the bypass channels 28 positioned circumferentially about an engine For example, and not by way of limitation, the active bypass flow control system 10 may control the flow through a collection of bypass channels 28 on either side of a gas turbine 21 but not control the flow of gases through bypass channels on the top and bottom of the gas turbine 21

The foregoing is provided for purposes of illustrating, explaining, and describing embodiments of this invention Modifications and adaptations to these embodiments will be apparent to those skilled in the art and may be made without departing from the scope or spirit of this invention

We claim:

1. An active bypass flow control system for an outer balance seal, comprising:

a stator assembly positioned in proximity to a first stage rotor whereby a compressed air channel is positioned between a portion of the stator assembly and a rotor shaft, at least one outer balance seal configured to at least reduce a portion of hot gases from flowing into a cooling cavity, at least one bypass channel extending from an inlet in fluid communication with the compressed air channel upstream of the at least one outer balance seal to an outlet in fluid communication with the compressed air channel downstream from the at least one outer balance seal, at least one metering device that is adjustable to adjust the flow of cooling fluids through the at least one bypass channel to accommodate a changing flow of compressed air past the at least one outer balance seal as the outer balance seal wears during turbine engine operation; and further comprising a position control system for controlling a position of the at least one metering device relative to the outlet of the at least one bypass channel, wherein the position control system further comprises at least one sensor configured to measure an amount of leakage flow occurring across the at least one metering device, wherein the metering device is adjusted to exhaust less compressed air from the outlet in response to data derived from the at least one sensor indicating wearing of the outer balance seal.

2. The active bypass flow control system of claim 1, wherein the at least one metering device is an annular ring having at least one metering orifice extending therethrough.

3. The active bypass flow control system of claim 2, wherein the at least one metering device is positioned at the outlet of the at least one bypass channel and is adjustable such that alignment of the at least one metering orifice with the outlet is adjustable to change a cross-sectional area of opening of aligned portions of the outlet of the at least one bypass channel and the at least one metering orifice of the at least one metering device.

4. The active bypass flow control system of claim 2, wherein the at least one metering device includes a plurality of metering orifices extending through the at least one metering device.

5. The active bypass flow control system of claim 4, wherein the plurality of metering orifices are positioned equidistant from each other.

6. The active bypass flow control system of claim 4, wherein the plurality of metering orifices are positioned in the at least one metering device such that each of the metering orifices is aligned with a bypass channel in an open state.

7. The active bypass flow control system of claim 1, wherein the position control system comprises a cam adjustor having an internal slot for receiving a post that retains the at least one metering device relative to the outlet of the at least one bypass channel, wherein the post is capable of being moved within the slot to change the position of the at least one metering device relative to the outlet of the at least one bypass channel.

8. The active bypass flow control system of claim 1, wherein the position control system further comprises at least one control lever for changing alignment of the at least one metering device relative to the outlet of the at least one bypass channel.

9. The active bypass flow control system of claim 1, wherein the position control system further comprises at least one motor usable to change alignment of the at least one metering device relative to the outlet of the at least one bypass channel.

10. The active bypass flow control system of claim 1, wherein the position control system further comprises a controller in communication with the at least one sensor and with at least one motor such that the controller controls operation of the at least one motor to control alignment of the at least one metering device relative to the outlet of the at least one bypass channel based upon data derived from the at least one sensor.

11. The active bypass flow control system of claim 1, wherein the at least one outer balance seal is a labyrinth seal formed from a plurality of teeth sealing a rim cavity from the cooling cavity.

12. The active bypass flow control system of claim 11, wherein the at least one outer balance seal is positioned on a radially inward end of the rim cavity between the rim cavity and the cooling cavity.

13. A gas turbine engine having an active bypass flow control system for an outer balance seal, comprising:

a stator assembly positioned in proximity to a first stage rotor whereby a compressed air channel is positioned between a portion of the stator assembly and a rotor shaft, at least one outer balance seal configured to at least reduce a portion of hot gases from flowing into a cooling cavity;

at least one bypass channel extending from an inlet in fluid communication with the compressed air channel upstream of the at least one outer balance seal to an outlet in fluid communication with the compressed air channel downstream from the at least one outer balance seal, at least one metering device that is adjustable to adjust the flow of cooling fluids through the at least one bypass channel to accommodate a changing flow of compressed air past the at least one outer balance seal as the outer balance seal wears during turbine engine operation, wherein the at least one metering device is an annular ring having at least one metering orifice extending therethrough, wherein the at least one metering device is positioned at the outlet of the at least one bypass channel and is adjustable such that alignment of the at least one metering orifice with the outlet is adjustable to change a cross-sectional area of opening of aligned portions of the outlet of the at least one bypass channel and the at least one metering orifice of the at least one metering device, and a position control system for controlling a position of the at least one metering device relative to the outlet of the at least one bypass channel, wherein the position control system further comprises at least one sensor configured to measure an amount of leakage flow occurring across the at least one metering device and further comprises a controller in communication with the at least one sensor and with at least one motor such that the controller controls operation of the at least one motor to control alignment of the at least one metering device relative to the outlet of the at least one bypass channel based upon data derived from the at least one sensor, wherein the metering device is adjusted to exhaust less compressed air from the outlet in response to the data derived from the at least one sensor indicating wearing of the outer balance seal.

14. The active bypass flow control system of claim 13, wherein the at least one metering device includes a plurality of metering orifices extending through the at least one metering device.

15. The active bypass flow control system of claim 14, wherein the plurality of metering orifices are positioned in the at least one metering device such that each of the metering orifices is aligned with a bypass channel in an open state.

16. The active bypass flow control system of claim 13, wherein the position control system comprises a cam adjustor having an internal slot for receiving a post that retains the at least one metering device relative to the outlet of the at least one bypass channel, wherein the post is capable of being moved within the slot to change the position of the at least one metering device relative to the outlet of the at least one bypass channel.

17. The active bypass flow control system of claim 13, wherein the position control system further comprises the at least one motor usable to change alignment of the at least one metering device relative to the outlet of the at least one bypass channel.

* * * * *